US007927127B1

(12) United States Patent
Glick et al.

(10) Patent No.: US 7,927,127 B1
(45) Date of Patent: Apr. 19, 2011

(54) ELECTRICAL TERMINAL DEVICE

(75) Inventors: Michael Glick, Farmington Hills, MI (US); Slobodan Pavlovic, Canton, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 12/580,476

(22) Filed: Oct. 16, 2009

(51) Int. Cl.
*H01R 4/24* (2006.01)

(52) U.S. Cl. ..... 439/397

(58) Field of Classification Search ..... 439/397, 439/399, 400, 856, 857
See application file for complete search history.

(56) References Cited

U.S. PATENT DOCUMENTS 3,380,013 A * 4/1968 Krone et al. ..... 439/391
4,209,217 A * 6/1980 Gudaitis et al. ..... 439/372
4,385,794 A * 5/1983 Lucius ..... 439/399
5,007,865 A * 4/1991 Jakobeit ..... 439/839
5,022,868 A 6/1991 Legrady
5,807,133 A 9/1998 Arnett
6,159,036 A 12/2000 Daoud
6,315,599 B1 11/2001 Daoud

* cited by examiner

*Primary Examiner* — Phuong K Dinh
(74) *Attorney, Agent, or Firm* — Brooks Kushman P.C.

(57) ABSTRACT

An electrical terminal device includes an insulation displacement connector section and a terminal section. The insulation displacement connector section has a connector slot formed therein which is configured to receive a first wire conductor. The terminal section is connected to the insulation displacement connector section and includes at least two beams configured to receive a second wire conductor. A distal end of at least one beam is displaced from a first position to a second position upon receipt by the at least two beams of the second wire. The at least one beam has a spring memory urging the distal end thereof toward the first position so that the at least two beams cooperate to hold the second wire. The insulation displacement connector section and the terminal section are made of a conductive material to provide an electrical connection between the first and second wires.

5 Claims, 4 Drawing Sheets

ELECTRICAL TERMINAL DEVICE

TECHNICAL FIELD

The following relates to an electrical terminal device having an insulation displacement connector and a female connection section.

BACKGROUND

Electrical terminal devices and insulation displacement connectors are well known in the art. Examples of insulation displacement connectors are shown in U.S. Pat. No. 5,022,868 entitled "Torsion Insulation Displacement Connector" and U.S. Pat. No. 5,807,133 entitled "Insulation Displacement Connector."

Additional examples of insulation displacement connectors, as well as various features thereof, are shown in U.S. Pat. No. 6,159,036 entitled "Locking Latch Mechanism For An Insulation Displacement Connector" and U.S. Pat. No. 6,315,599 entitled "Strain Relief Mechanism For Insulation Displacement Connector."

SUMMARY

According to one embodiment disclosed herein, an electrical terminal device is provided. The terminal device comprises an insulation displacement connector section having a connector slot formed therein. The connector slot is configured to receive a first wire conductor.

In this embodiment, the electrical terminal device further comprises a terminal section connected to the insulation displacement connector section. The terminal section comprises at least two beams configured to receive a second wire conductor. At least one beam of the at least two beams has a distal end that deflects from a first position to a second position upon receipt by the at least two beams of the second wire. The at least one beam has a spring memory urging the distal end of the at least one beam toward the first position so that the at least two beams cooperate to hold the second wire. The insulation displacement connector section and the terminal section comprise a conductive material such that the electrical terminal device provides an electrical connection between the first and second wires.

According to another embodiment disclosed herein, an electrical terminal device is provided that comprises an insulation displacement connector section having a connector slot formed therein. The connector slot is configured to receive a first wire conductor.

In this embodiment, the electrical terminal device further comprises a terminal section connected to the insulation displacement connector section. The terminal section comprises two beams configured to receive a second wire conductor. Each of the two beams has a distal end that deflects from a first position to a second position upon receipt by the two beams of the second wire. Each of two beams also has a spring memory urging the distal end thereof toward the first position so that the two beams cooperate to hold the second wire therebetween. The insulation displacement connector section and the terminal section comprise a conductive material such that the electrical terminal device provides an electrical connection between the first and second wires.

According to a further embodiment disclosed herein, an electrical terminal device is provided that comprises an insulation displacement connector section comprising a pair of opposed end walls and a side wall disposed between the end walls. Each end wall has a connector slot formed therein. The connector slots are aligned in an offset configuration relative to each other along a longitudinal axis extending between the opposed end walls. The connector slots are configured to receive a first wire conductor.

In this embodiment, the electrical terminal device further comprises a terminal section comprising at least two beams configured to receive a second wire conductor. At least one beam of the at least two beams has a distal end that deflects from a first position to a second position upon receipt by the at least two beams of the second wire. The at least one beam has a spring memory urging the distal end thereof toward the first position so that the at least two beams cooperate to hold the second wire.

In this embodiment, the electrical terminal device further comprises an intermediate section disposed between the terminal section and the insulation displacement connector section. The intermediate section is for use in alignment of the electrical terminal device in a connector housing. The IDC section, terminal section and intermediate section comprise a conductive material such that the electrical terminal device provides an electrical connection between the first and second wires.

A detailed description of these embodiments of an electrical terminal device and accompanying drawing are set forth below.

DETAILED DESCRIPTION

Figure 1:
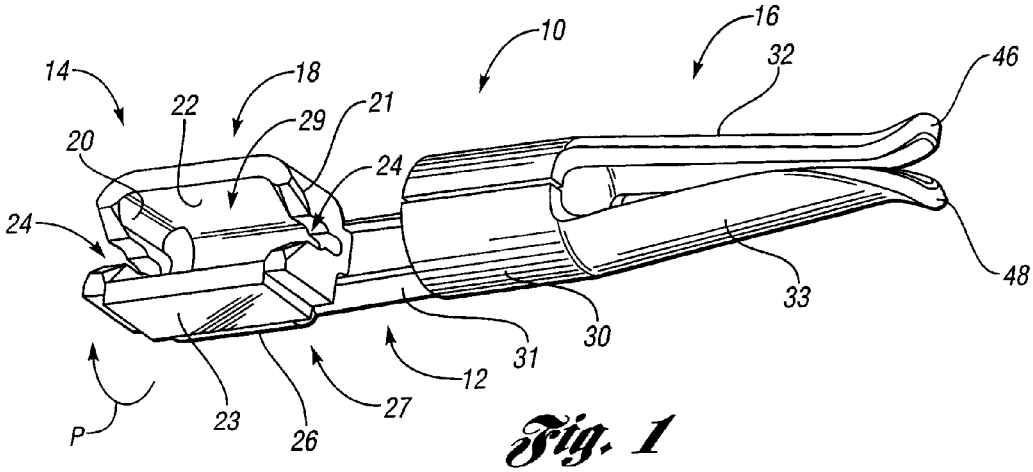
FIG. 1 is a perspective view of one embodiment of an electrical terminal device disclosed herein.

With reference to the Figures, a more detailed description of various embodiments of an electrical terminal device will now be provided. Referring first to FIG. 1, a perspective view of one embodiment of an electrical terminal device (10) is shown. As seen therein, the terminal device (10) may comprise an insulation displacement connector section (14) and a terminal section (16). The insulation displacement connector section (14) may be connected to the terminal section (16) by an intermediate section (12).

The insulation displacement connector section (14), intermediate section (12), and terminal section (16) may be formed of a copper clad stainless steel (CCSS) alloy, of other copper alloy or conductive material suitable for use herein, including performing the functions described. The insulation displacement connector section (14), intermediate section (12), and terminal section (16), or any combination thereof, may be formed as an integral unit, such from an appropriately stamped and bent piece of sheet metal, or may be assembled in any fashion known in the art.

As seen in FIG. 1, the insulation displacement connector section (14) may take the form of a box or housing (18) having a pair of opposed end walls (20, 21) and a pair of opposed side walls (22, 23), each side wall (22, 23) disposed between the pair of end walls (20, 21). Each end wall (20, 21) may have a connector slot (24) formed therein. While specifically shown and described herein configured as a box or housing (18), it should be noted that the insulation displacement connector section (14) may be configured differently.

Figure 2:
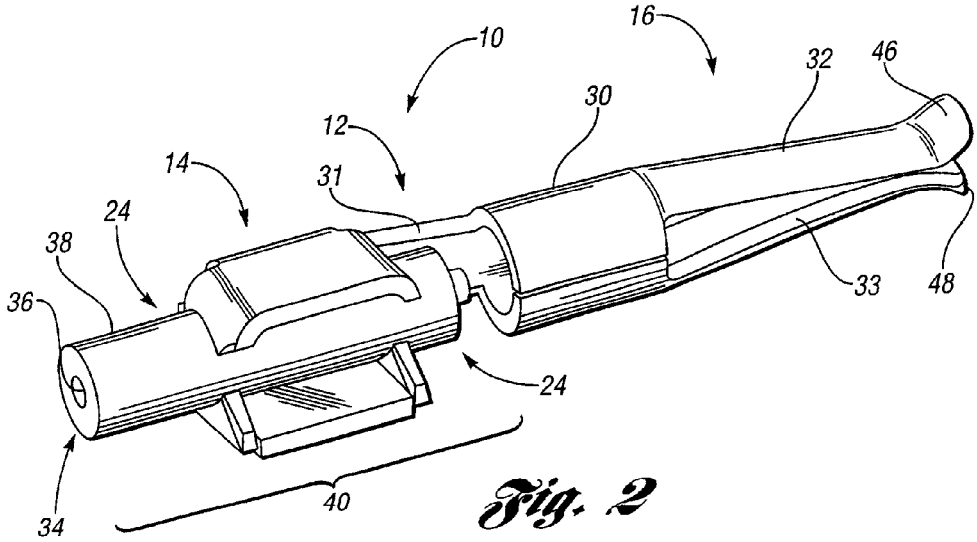
FIG. 2 is a perspective view of the electrical terminal device of FIG. 1 showing that device in use with a first wire conductor.

Referring now to FIG. 2, a perspective view of the terminal device (10) of FIG. 1 is shown, the terminal device (10) in use with a wire (34) having a conductive core (36) and an insulation coating (38). As is well known in the art, an end portion (40) of a wire (34) is inserted into the connector slots (24) so that the insulation coating (38) of the wire (34) is pierced or displaced by the edges of the connector slots (24). In such a fashion, an electrical connection is established between the conductive core (36) of the wire (34) and the edges of the connector slots (24). As is also well known in the art, the terminal device (10) may be used as part of any number of electrical devices, such as a connector (not shown), wire harness (not shown), or mounted on a printed circuit board (not shown). In that regard, the terminal device (10) may also be electrically connected to other electrical components, such as through conductive leads (not shown) in a connector or wire harness, or through conductive traces (not shown) on a printed circuit board.

With reference to FIGS. 1 and 2, according to one embodiment of the terminal device (10), one side wall (23) of the box or housing (18) of the insulation displacement connector section (14) may be configured for pivotal motion about a hinge (26) which may be provided between an edge of the side wall (23) and a base (27) of the box or housing (18). In such an embodiment, the side wall (23) may be disposed between, but not attached to, end walls (20, 21). As a result, the side wall (23) may pivot about hinge (26) in the direction shown by arrow P toward the space or cavity (29) created by the end walls (20, 21), the side walls (22, 23), and the base (27). Alternatively, the side wall (23) of the insulation displacement connector section (14) may have a tab or portion (not shown) extending therefrom and configured for similar pivotal motion. The side wall (23), or any portion, tab or extension thereof, may alternatively be configured for movement toward the cavity (29) in any other manner known to those of ordinary skill in the art.

In such a fashion, the side wall (23), or any portion, extension or tab thereof, may be used to urge, move or drive the end portion (40) of the wire (34) traversing the cavity (29) between the end walls (20, 21) into the connector slots (24). The side wall (23), or any portion thereof, may also be configured to latch at a substantially fixed position within the cavity (29) between the end walls (20, 21) in order to retain or substantially secure the end portion (40) of the wire (34) in the connector slots (24). To latch in such a fashion, the side wall (23) and one or both end walls (20, 21) may be provided with cooperating latch elements (not shown) in any manner known in the art.

Figure 3:
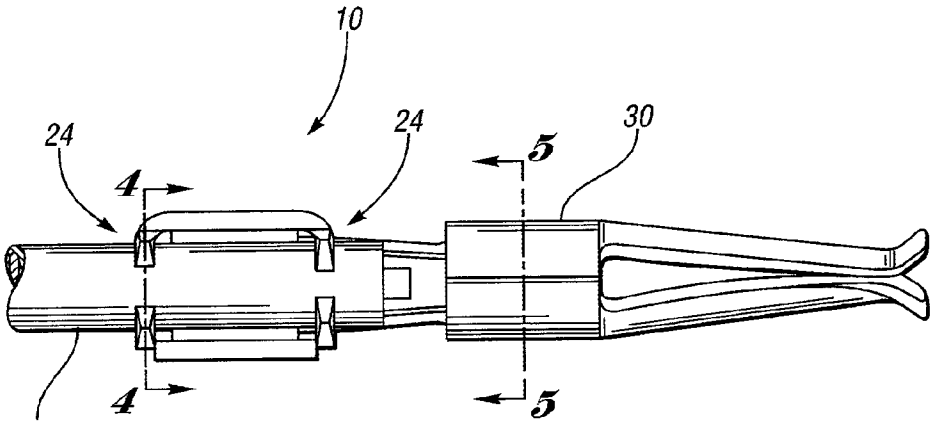
FIG. 3 is a top view of the electrical terminal device and first wire conductor of FIG. 2.
Figure 4:
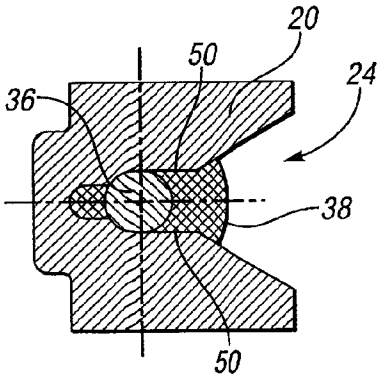
FIG. 4 is a cross-sectional view of the electrical terminal device and first wire conductor of FIG. 3, taken along line 4-4.

Referring now to FIG. 3, a top view of the electrical terminal device (10) and the wire conductor (34) of FIG. 2 is shown. FIG. 4 depicts a cross-sectional view of the electrical terminal device (10) and wire conductor (34) shown in FIG. 3, taken along line 4-4. As previously described, the insulation coating (38) of the wire (34) is pierced or displaced such that the edges (50) of the connector slot (24) make contact with the conductive core (36) of the wire (34), thereby establishing an electrical connection therebetween.

As seen in FIG. 4, connector slots (24) may be substantially aligned with each other along a line extending between the end walls (20, 21), such as longitudinal axis, L, of the terminal device (10). Alternatively, however, connector slots (24) may be provided with an offset alignment relative to each other along the longitudinal axis, L, of the terminal device (10) or any line extending between the end walls (20, 21). Such an offset configuration of the connector slots (24) serves to add a sideways stretch to the wire (34) between the connector slots (24) to improve locking or retention of the wire (34) in the connector slots (24).

Figure 5:
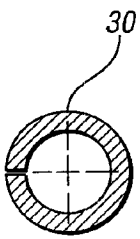
FIG. 5 is a cross-sectional view of the electrical terminal device of FIG. 3, taken along line 5-5.

Referring again to FIGS. 1 and 2, as previously described, the insulation displacement connector section (14) may be connected to the terminal section (16) of the terminal device (10) by an intermediate section (12). As seen therein, the intermediate section (12) of the terminal device (10) comprises a substantially cylindrical barrel portion (30) and a bridge portion (31). The bridge portion (31) extends from one end of the barrel portion (30) and connects the barrel portion (30) to the insulation displacement connector section (14). In that regard, FIG. 5 depicts a cross-sectional view of the electrical terminal device (10) shown in FIG. 3, taken along line 5-5. As seen therein, the barrel portion (30) of the intermediate section (12) has a substantially circular cross-section. The intermediate section (12) may, however, include a portion having any other form known in the art, such as a trough with a substantially semi-circular cross-section, or a box with a substantially rectangular, hexagonal or other cross-sectional shapes.

Still referring to FIGS. 1 and 2, the terminal section (16) may comprise a pair of terminal beams (32, 33). The terminal beams (32, 33) may extend from the opposite end of the barrel portion (30) of the intermediate section (12), and each beam (32, 33) may have a distal end (46, 48). In that regard, intermediate section (12), including barrel portion (30), acts a base for the terminal beams (32, 33), providing rigidity thereto. The intermediate section (12) may also be used for proper alignment of the terminal device (10) within a connector housing (not shown), which may be formed of a plastic or other suitable material.

The beams (32, 33) may extend from barrel portion (30) of the intermediate section (12) or be otherwise configured such that the distal ends (46, 48) substantially meet at a distance from the intermediate section (12) and/or the insulation displacement connector section (14). In that regard, as shown in FIGS. 1 and 2, the beams (32, 33) extend from opposite sides of substantially cylindrical barrel of intermediate section (12) at an angle so that the beams (32, 33) substantially meet at or near their distal ends (46, 48).

Figure 6:
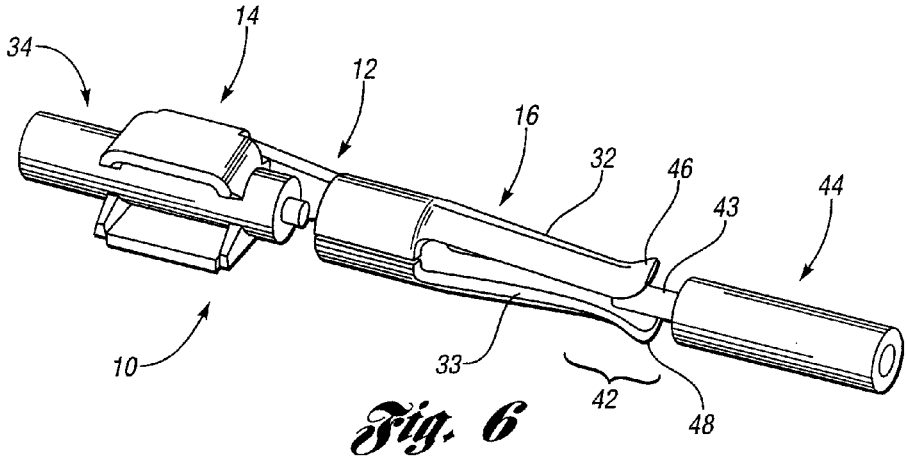
FIG. 6 is a perspective view of the electrical terminal device of FIG. 1 showing that device in use with first and second wire conductors.

Referring now to FIG. 6, a perspective view of the electrical terminal device (10) of FIG. 1 is shown, the terminal device (10) in use with first and second wire conductors (34, 44). As seen therein, the beams (32, 33) are configured to receive an end portion (42) of the conductive core (43) of the second wire conductor (44). In that regard, the beams (32, 33) are formed such that, upon receipt of the end portion (42) of the conductive core (43) of the wire (44) between the beams (32, 33), the distal ends (46, 48) of the beams (32, 33) are displaced from a normal or first position (as seen in FIGS. 1 and 2) to a deflected or second position (as seen in FIG. 6). With the receipt of the end portion (42) of the wire (44) between the beams (32, 33) and the displacement of the distal ends (46, 48), the spring memory of each beam (32, 33) urges the distal ends (46, 48) toward their normal position such that the distal ends (46, 48) of the beams (32, 33) clamp or secure the end portion (42) of the wire (44). In such a fashion, the beams (32, 33) of the terminal section (16) cooperate to hold the end portion (42) of the wire (44) therebetween.

While two terminal beams (32, 33) are specifically shown and described herein, it should be noted that the number of terminal beams need not be limited to two. Three or more beams could be employed to the same effect, namely, cooperating to hold the end portion (42) of conductive core (43) of the second wire conductor (44). Regardless, the terminal device (10) thus provides a female terminal that receives the conductive core (43) of the wire conductor (44) directly. In such a fashion, the terminal device (10) may be configured within a connector housing (not shown), which may be constructed of plastic or other suitable material, where the connector housing is provided with an opening for inserting the conductive core (43) of the wire conductor (44) between the terminal beams (32, 33). Thus, the wire conductor (44) may be used in place of and eliminates the need for a male terminal.

Figure 7:
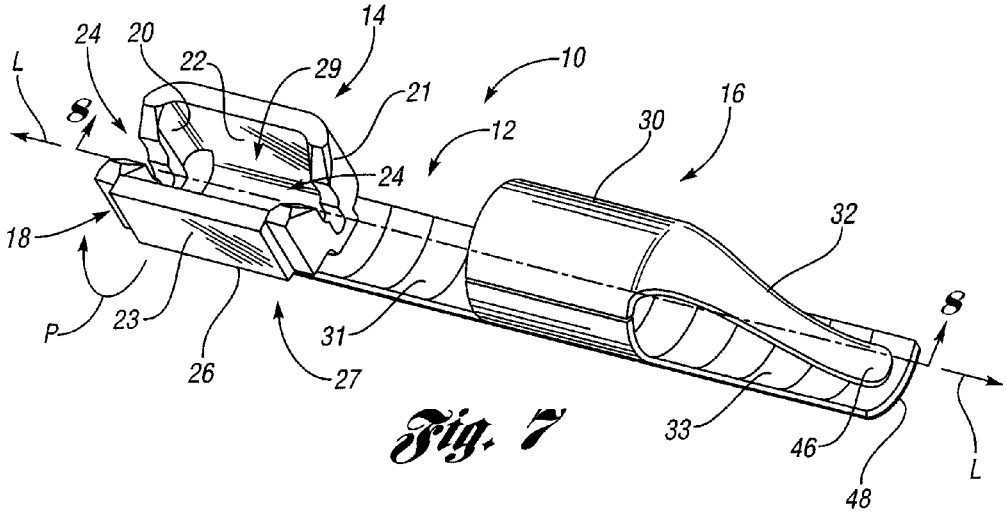
FIG. 7 is a perspective view of another embodiment of the electrical terminal device disclosed herein.

Referring next to FIG. 7, a perspective view of another embodiment of an electrical terminal device (10) is shown. As seen therein, the terminal device (10) again may comprise an insulation displacement connector section (14) and a terminal section (16). Insulation displacement connector section (14) may again be connected to terminal section (16) by an intermediate section (12). The insulation displacement connector section (14), intermediate section (12), and terminal section (16) are again preferably formed of a copper alloy or other conductive material suitable for use in known terminal devices and insulation displacement connectors, and suitable for performing the functions described herein. The insulation displacement connector section (14), intermediate section (12), and terminal section (16), or any combination thereof, may again be formed as an integral unit, such from an appropriately stamped and bent piece of sheet metal, or may be assembled in any fashion known in the art.

The insulation displacement connector section (14) again may take the form of a box or housing (18) having a pair of opposed end walls (20, 21) and a pair of opposed side walls (22, 23), each side wall (22, 23) disposed between the pair of end walls (20, 21). Each end wall (20, 21) may have a connector slot (24) formed therein. While specifically shown and described herein configured as a box or housing (18), it should be noted that the insulation displacement connector section (14) may again be configured differently.

Figure 8:
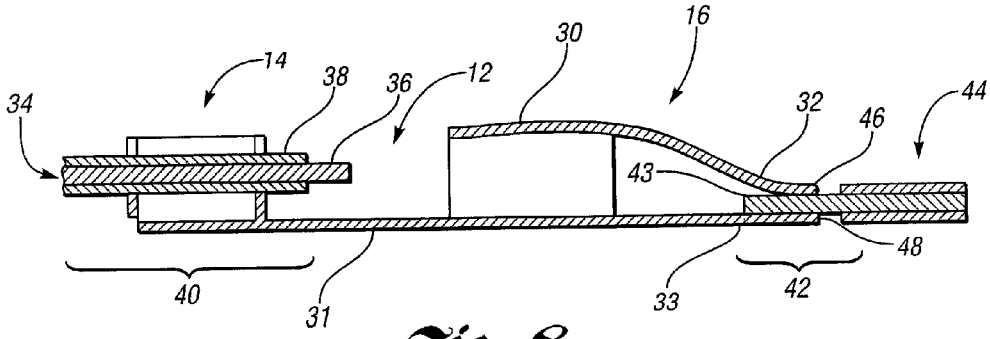
FIG. 8 is a cross-sectional view the electrical terminal device of FIG. 7, taken along line 8-8, showing that device in use with first and second wire conductors.

FIG. 8 depicts a cross-sectional view of the terminal device (10) of FIG. 7, taken along line 8-8, showing the terminal device (10) in use with first and second wire conductors (34, 44). As previously described in connection with FIGS. 1 and 2, as is well known in the art, an end portion (40) of a wire conductor (34) is again inserted into the connector slots (24) so that the insulation coating (38) of the wire (34) is pierced or displaced by the edges of the connector slots (24). In such a fashion, an electrical connection is established between the conductive core (36) of the wire (34) and the edges of the connector slots (24). Once again, as is also well known in the art, the terminal device (10) may be used as part of any number of electrical devices, such as a connector (not shown), wire harness (not shown), or mounted on a printed circuit board (not shown). In that regard, the terminal device (10) may also be electrically connected to other electrical components, such as through conductive leads (not shown) in a connector or wire harness, or through conductive traces (not shown) on a printed circuit board.

Referring again to FIG. 7, according to this embodiment of the terminal device (10), one side wall (23) of the box or housing (18) of the insulation displacement connector section (14) may again be configured for pivotal motion about a hinge (26) which may be provided between an edge of the side wall (23) and a base (27) of the box or housing (18). In such an embodiment, the side wall (23) may be disposed between, but not attached to, end walls (20, 21). As a result, the side wall (23) may pivot about hinge (26) in the direction shown by arrow P toward the space or cavity (29) created by the end walls (20, 21), the side walls (22, 23), and the base (27). Alternatively, the side wall (23) of the insulation displacement connector section (14) may again have a tab or portion (not shown) extending therefrom and configured for similar pivotal motion. The side wall (23), or any portion, tab or extension thereof, may again alternatively be configured for movement toward the cavity (29) in any other manner known to those of ordinary skill in the art.

In such a fashion, the side wall (23), or any portion, extension or tab thereof, may again be used to urge, move or drive the end portion (40) of the wire (34) traversing the cavity (29) between the end walls (20, 21) into the connector slots (24). The side wall (23), or any portion thereof, may again also be configured to latch at a substantially fixed position within the cavity (29) between the end walls (20, 21) in order to retain or substantially secure the end portion (40) of the wire (34) in the connector slots (24). To latch in such a fashion, the side wall (23) and one or both end walls (20, 21) may again be provided with cooperating latch elements (not shown) in any manner known in the art.

As seen in FIG. 7, connector slots (24) may again be substantially aligned with each other along a line extending between the end walls (20, 21), such as longitudinal axis, L, of the terminal device (10). Alternatively, however, connector slots (24) may again be provided with an offset alignment relative to each other along the longitudinal axis, L, of the terminal device (10) or any line extending between the end walls (20, 21). Such an offset configuration of the connector slots (24) again serves to add a sideways stretch to the wire (34) between the connector slots (24) to improve locking or retention of the wire (34) in the connector slots (24).

Referring still to FIG. 7, as previously described, the insulation displacement connector section (14) may again be connected to the terminal section (16) of the terminal device (10) by an intermediate section (12). As seen therein, the intermediate section (12) of the terminal device (10) again may comprise a substantially cylindrical barrel portion (30) having a substantially circular cross-section, and a bridge portion (31). The bridge portion (31) extends from one end of the barrel portion (30) and connects the barrel portion (30) to the insulation displacement connector section (14). The intermediate section (12) may, however, include a portion having any other form known in the art, such as a trough with a substantially semi-circular cross-section, or a box with a substantially rectangular, hexagonal or other cross-sectional shapes.

The terminal section (16) may again comprise a pair of terminal beams (32, 33). The terminal beams (32, 33) may extend from the opposite end of the barrel portion (30) of the intermediate section (12), and each beam (32, 33) has a distal end (46, 48). In that regard, intermediate section (12), including barrel portion (30), acts a base for the terminal beams (32, 33), providing rigidity thereto. The intermediate section (12) may also be used for proper alignment of the terminal device (10) within a connector housing (not shown), which may be formed of a plastic or other suitable material.

The beams (32, 33) may again extend from an end of the barrel portion (30) of the intermediate section (12) or be otherwise configured such that the distal ends (46, 48) substantially meet at a distance from the intermediate section (12) and/or the insulation displacement connector section (14). In that regard, as shown in FIGS. 7 and 8, the beam (33) extends from the end of the barrel portion (30) in a substantially collinear fashion with the bridge portion (31) of the intermediate section (12), while beam (32) extends from the opposite side of the barrel portion (30) of the intermediate section at an angle so that the beams (32, 33) substantially meet at or near their distal ends (46, 48).

The beams (32, 33) are again configured to receive an end portion (42) of a conductive core (43) of a second wire conductor (44). According to this embodiment, however, only one beam (32) is configured such that, upon receipt of the end portion (42) of the wire (44) between the beams (32, 33), the distal end (46) of the beam (32) is displaced from a normal or first position (as seen in FIG. 7) to a deflected or second position (as seen in FIG. 8). With the receipt of the end portion (42) of the wire (44) between the beams (32, 33) and the displacement of the distal end (46), the spring memory of beam (32) urges the distal end (46) toward its normal position such that the distal end (46) of the beam (32) clamps or secures the end portion (42) of the wire (44) against the other beam (33). In such a fashion, the beams (32, 33) of the terminal section (16) cooperate to hold the end portion (42) of the wire (34) therebetween.

While two terminal beams (32, 33) are specifically shown and described herein, it should be noted that the number of terminal beams need not be limited to two. Three or more beams could be employed to the same effect, namely, cooperating to hold the second portion (42) of the wire (34). Regardless, the terminal device (10) thus again provides a female terminal that receives the conductive core (43) of the wire conductor (44) directly. In such a fashion, the terminal device (10) may be configured within a connector housing (not shown), which may be constructed of plastic or other suitable material, where the connector housing is provided with an opening for inserting the conductive core (43) of the wire conductor (44) between the terminal beams (32, 33). Thus, the wire conductor (44) may again be used in place of and eliminates the need for a male terminal.

Figure 9:
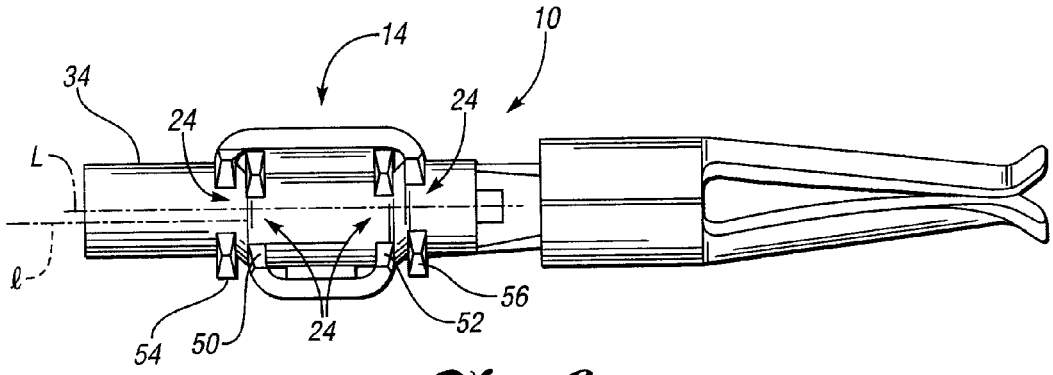
FIG. 9 is a top view of a further embodiment of the electrical terminal device disclosed herein.
Figure 10:
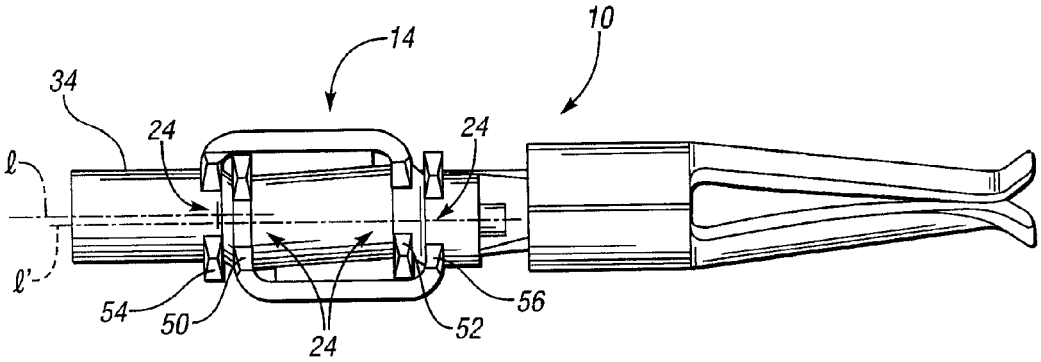
FIG. 10 is a top view of a still further embodiment of the electrical terminal device disclosed herein.

Referring next to FIGS. 9 and 10, top views of further embodiments of an electrical terminal device (10) are shown. As previously described in connection with FIGS. 4 and 7, the connector slots (24) of the walls (20, 21) may be offset relative to each other to improve the locking or retention of the wire (34) in the connector slots (24). As seen in FIGS. 9 and 10, additional walls each having connector slots (24) formed therein may be provided as part of the insulation displacement connector section (14) to further improve the retention of the wire (34) in connector slots (24).

More specifically, the insulation displacement connector section (14) may be provided with a pair of interior walls (50, 52) and a pair of exterior walls (54, 56), each having a connector slot (24) formed therein. As seen in FIG. 9, the connector slots (24) in each of the exterior walls (54, 56) may be aligned with each other along a line extending between the exterior walls (54, 56), such as longitudinal axis, L. The connector slots (24) in each of the interior walls (50, 52) may be aligned with each other along another line, such as l, extending between the interior walls (50, 52), where the respective lines, L and l, along which the connector slots (24) are aligned are offset from each other.

Alternatively, as seen in FIG. 10, one of the connector slots (24) in one of the exterior walls (54) may be aligned with one of the connector slots (24) in one of the interior walls (52) along a line, such as l, extending between those two walls (52, 54). The connector slot (24) in the other exterior wall (56) may be aligned with the connector slot (24) in the other interior wall (50) along a line, such as line, l', extending between those walls (50, 56), where the respective lines, l and l', along which the connector slots (24) are aligned are offset from each other. In either of the embodiments of FIGS. 9 and 10, as seen in both Figures, such an offset configuration of the connector slots (24) serves to add one or more sideways stretches to the wire (34) between the connector slots (24) to improve locking or retention of the wire (34) in the connector slots (24).

From the foregoing it can be seen that various embodiments of an improved electrical terminal device (10) have been disclosed. Advantageously, the terminal device (10) provides a female terminal capable of receiving a wire conductor (44) directly, such that the wire conductor acts as a male terminal and the need for a corresponding male terminal is eliminated. More specifically, the design of the terminal device (10) allows a conductive core (43) of a wire conductor (44) to be used in place of a male terminal.

Moreover, the design of the terminal device (10) is well suited for ultra-small or miniaturized implementation for use in small spaces, allowing the terminal device (10), the wire (34, 44) used therewith, and any connector, connector system, wire harness or jumper harness incorporating the terminal device (10) to be made as small as possible, thereby allowing for the termination of extremely thin wires. In that regard, the insulation displacement connector section (14) and terminal section (16) may be configured for use with specific wire sizes, which may be the same or different for the insulation displacement connector and terminal sections (14, 16).

To help achieve the structural strength of prior art male/female terminals while maintaining good conductivity in the thinnest or smallest material thickness or diameter, the wire (44) used with the terminal device (10) may be formed from a copper clad stainless steel (CCSS) alloy. The insulation displacement connector section (14) and terminal section (16), as well as the intermediate section (12), may also be manufactured from a CCSS alloy or other suitable conductor, and may be integrally formed from, such as from a single piece of appropriately stamped and bent sheet metal, or may be assembled in any known fashion. In addition, the insulation displacement connector section (14) design improves termination of the wire (34) in the terminal device (10).

More specifically, the design of the electrical terminal device (10) is particularly cost-effective for ultra-small or miniaturized applications, where mechanical robustness can be a problem due to the small diameter of the wire used and the small thickness of the sheet metal used for the terminal. The design of the electrical terminal device (10) using copper clad steel metal sheet (e.g., 0.1-0.15 mm) and copper clad steel wire (e.g., 0.5 mm) with a single core structure (e.g., 30% copper) helps to provide adequate mechanical robustness. The insulation displacement connector (14), female terminal (16) and wires (34, 44) of such sizes will have improved mechanical performance due to the use of steel. That is, the insulation displacement connector section (14) will have greater strength despite small thickness, and the steel core of the female terminal (16) and wires (34, 44) will have sufficient robustness for automotive applications. Moreover, the copper cladding (e.g., 30%) over a steel core for the wires (34, 44) is sufficient to carry signal level currents (e.g., 1 A).

The design of the terminal device (10) thereby reduces both cost and weight, and improves reliability. The terminal device (10) has a design that provides advantages for all low power and signal applications, particularly in hybrid and electric vehicles. Moreover, by eliminating a male terminal and allowing the use of smaller gauge wire, the design of the terminal device (10) provides for lower cost, lighter weight/lower mass wire harnesses having the same performance level as prior art wire harnesses, yet improving vehicle fuel efficiency While various embodiments of an electrical terminal device have been illustrated and described, it is not intended that these embodiments illustrate and describe all possible forms of that device. Instead, the words used herein are words of description rather than limitation, and it is understood that various changes may be made to these embodiments without departing from the spirit and scope of the following claims.

What is claimed is:

1. An electrical terminal device comprising:

an insulation displacement connector (IDC) section comprising a pair of opposed walls, each wall having a connector slot formed therein, the connector slots configured to receive a first wire conductor;

an intermediate section attached to the IDC section, the intermediate section comprising a portion having a substantially cylindrical shape; and a terminal section attached to the intermediate section, the terminal section comprising a plurality of beams configured to receive a second wire conductor, each of the plurality of beams extending from the substantially cylindrical portion of the intermediate section and having an arcuate shape with a concave wire contact surface, at least one of the plurality of beams deflecting from a first position to a second position upon receipt by the plurality of beams of the second wire, the at least one of the plurality of beams having a spring memory urging the at least one of the plurality of beams toward the first position so that the plurality of beams cooperate to hold the second wire;

wherein the shape of the substantially cylindrical portion of the intermediate section provides rigidity to the plurality of arcuate beams extending therefrom, wherein the concave wire contact surface of each of the plurality of beams is configured for nesting contact with a substantially cylindrical surface of the second wire, and wherein the IDC, intermediate and terminal sections are integrally formed from a single electrically conductive sheet to provide an electrical connection between the first and second wire conductors.

2. The electrical terminal device of claim 1 wherein the single conducting sheet comprises a sheet metal.

3. The electrical terminal device of claim 1 wherein the single conductive sheet comprises copper clad steel.

4. The electrical terminal device of claim 1 wherein the connector slots formed in the opposed side walls of the IDC section are provided in a non-aligned configuration relative to each other along a line extending substantially perpendicularly between the opposed walls.

5. The electrical terminal device of claim 1 wherein the substantially cylindrical portion of the intermediate section is for use in alignment of the electrical terminal device in a connector housing.

* * * * *